US012448239B2

(12) United States Patent
Kobayashi

(10) Patent No.: US 12,448,239 B2
(45) Date of Patent: Oct. 21, 2025

(54) SHEET REMOVER, CONVEYING DEVICE, AND IMAGE FORMING APPARATUS

(71) Applicant: Yukifumi Kobayashi, Kanagawa (JP)

(72) Inventor: Yukifumi Kobayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 282 days.

(21) Appl. No.: 18/142,581

(22) Filed: May 3, 2023

(65) Prior Publication Data

US 2023/0406655 A1 Dec. 21, 2023

(30) Foreign Application Priority Data

May 18, 2022 (JP) ..... 2022-081537
Mar. 24, 2023 (JP) ..... 2023-048093

(51) Int. Cl.
*B65H 5/00* (2006.01)

(52) U.S. Cl.
CPC ..... *B65H 5/00* (2013.01); *B65H 2402/441* (2013.01); *B65H 2601/11* (2013.01)

(58) Field of Classification Search
CPC ..... B65H 2402/441; B65H 2601/11; B65H 2601/325; B65H 29/008; B65H 2511/528; B65H 2407/20; B65H 9/02; G03G 21/1638; G03G 15/70
See application file for complete search history.

(56) References Cited

U.S. PATENT DOCUMENTS 7,185,888 B2 * 3/2007 Duff ..... B65H 29/008 271/225
8,170,427 B2 * 5/2012 Morita ..... B65H 29/008 399/21
2009/0196635 A1 8/2009 Morita
2015/0151938 A1 6/2015 Matsumoto et al.
2015/0186762 A1 7/2015 Nishimura et al.
2015/0293487 A1 10/2015 Takenaga et al.
2016/0090256 A1 3/2016 Nakayama et al.
2016/0100072 A1 4/2016 Kobayashi et al.
2016/0221780 A1 8/2016 Nishimura et al.
(Continued)

FOREIGN PATENT DOCUMENTS

CN 103224151 A 7/2013
CN 206084827 U 4/2017
(Continued)

OTHER PUBLICATIONS

Extended European search report issued on Sep. 29, 2023, in corresponding European patent Application No. 23169813.5, 8 pages.

(Continued)

*Primary Examiner* — Leslie A Nicholson, III
(74) *Attorney, Agent, or Firm* — XSENSUS LLP

(57) ABSTRACT

A sheet remover includes a pair of insertion-part formers and a pair of through-part formers. The pair of insertion-part formers forms an insertion part between the pair of insertion-part formers into which a sheet is inserted. The pair of through-part formers forms a through part between the pair of through-part formers through which the sheet is inserted. The through part is located downstream from the insertion part in a sheet insertion direction in which the sheet is inserted.

13 Claims, 13 Drawing Sheets

(56) References Cited

U.S. PATENT DOCUMENTS

| | | | |
|---|---|---|---|
| 2017/0097601 | A1 | 4/2017 | Takenaga et al. |
| 2017/0131671 | A1 | 5/2017 | Nishimura et al. |
| 2017/0176908 | A1 | 6/2017 | Kobayashi et al. |
| 2018/0364627 | A1 | 12/2018 | Kobayashi et al. |
| 2019/0111559 | A1 | 4/2019 | Beck |
| 2019/0171137 | A1 | 6/2019 | Kobayashi |
| 2019/0171154 | A1 | 6/2019 | Kobayashi et al. |
| 2020/0264546 | A1 | 8/2020 | Kobayashi |
| 2022/0404754 | A1 | 12/2022 | Kobayashi |

FOREIGN PATENT DOCUMENTS

| | | | | | |
|---|---|---|---|---|---|
| CN | 209999013 | U | | 1/2020 | |
| JP | S6056642 | U | * | 4/1985 | |
| JP | 63-112047 | | | 7/1988 | |
| JP | H08-323633 | A | | 12/1996 | |
| JP | 2003040481 | A | * | 2/2003 | |
| JP | 2004-133485 | | | 4/2004 | |
| JP | 2007-171222 | | | 7/2007 | |
| JP | 2007171222 | A | * | 7/2007 | |
| JP | 2007-308303 | | | 11/2007 | |
| JP | 2009-222864 | A | | 10/2009 | |
| JP | 2012-200849 | A | | 10/2012 | |
| JP | 2019182655 | A | * | 10/2019 | ..... B65H 29/125 |

OTHER PUBLICATIONS

Office Action issued Jul. 31, 2025 in corresponding Chinese Patent Application No. 202310499237.8.

* cited by examiner

SHEET REMOVER, CONVEYING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2022-081537, filed on May 18, 2022, and 2023-048093, filed on Mar. 24, 2023, in the Japan Patent Office, the entire disclosure of each of which is hereby incorporated by reference herein.

BACKGROUND

Technical Field

Embodiments of the present disclosure relate to a sheet remover, a conveying device, and an image forming apparatus.

Related Art

When a sheet is jammed in an image forming apparatus during an image forming operation, a door on a housing of the image forming apparatus is opened to open the inside of the apparatus and manually remove the jammed sheet.

SUMMARY

According to an embodiment of the present disclosure, a novel sheet remover includes a pair of insertion-part formers and a pair of through-part formers. The pair of insertion-part formers forms an insertion part between the pair of insertion-part formers into which a sheet is inserted. The pair of through-part formers forms a through part between the pair of through-part formers through which the sheet is inserted. The through part is located downstream from the insertion part in a sheet insertion direction in which the sheet is inserted. Also described are novel conveying device incorporating the sheet remover and image forming apparatus incorporating the conveying device.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
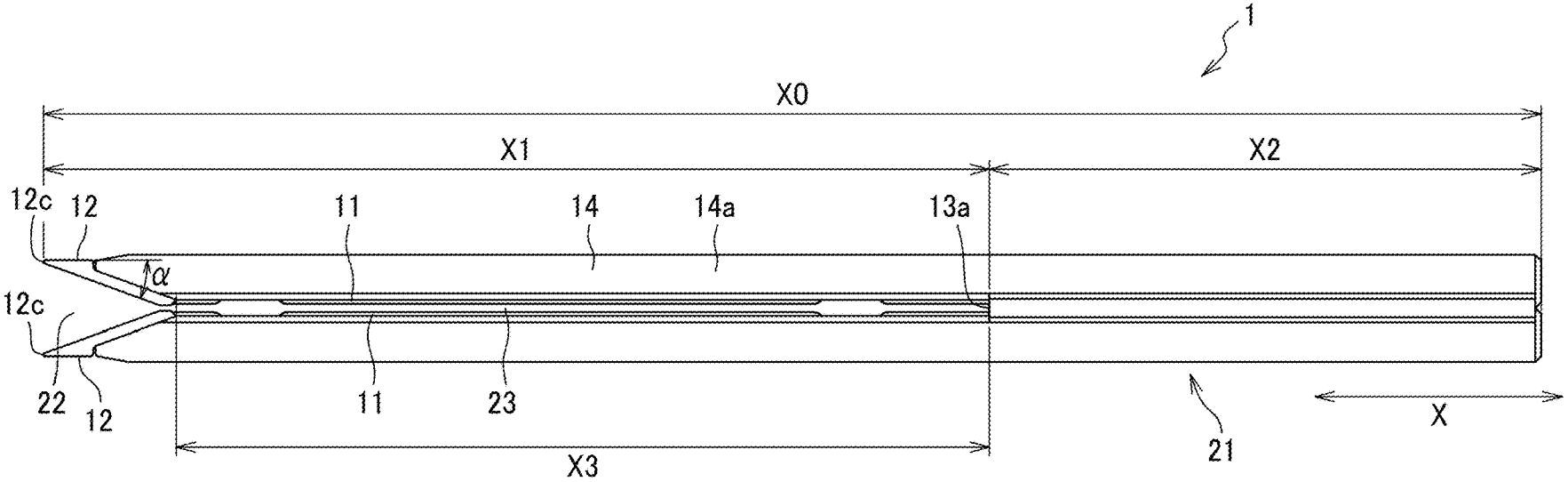
FIG. 1 is an external view of a sheet remover according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a." "an," and "the" are intended to include the plural forms as well, unless the context clearly indicates otherwise.

For the sake of simplicity, like reference numerals are given to identical or corresponding constituent elements such as parts and materials having the same functions, and redundant descriptions thereof are omitted unless otherwise required.

FIG. 1 is a plan view of a sheet remover 1 according to an embodiment of the present disclosure.

Figure 2:
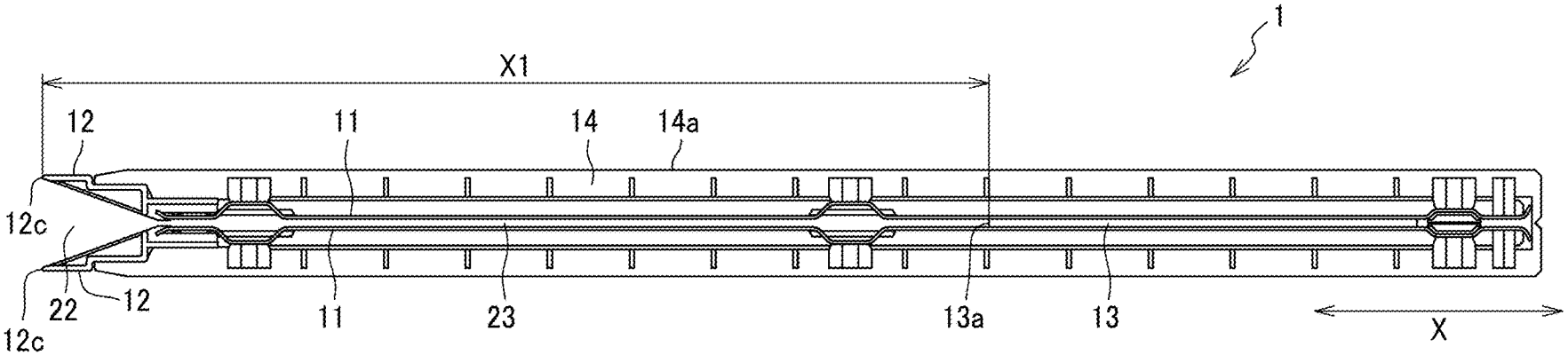
FIG. 2 is a cross-sectional view of the sheet remover of FIG. 1.

FIG. 2 is a cross-sectional view of the sheet remover 1. FIG. 2 illustrates an internal configuration of the sheet remover 1.

The sheet remover 1 is used to hold (particularly, wind in the present embodiment) a sheet jammed on the way in a conveying device and take out the sheet to the outside of the conveying device.

As illustrated in FIGS. 1 and 2, the sheet remover 1 includes a pair of sheet holding plates 11 as a pair of through-part formers, a pair of leading-end claws 12 as a pair of insertion-part formers, a gap formation plate 13, and a winding guide 14. The sheet remover 1 is a rod-shaped device extending in a direction indicated by a double-headed arrow X, which is a lateral direction in FIG. 1. In the following description, the direction that is indicated by the double-headed arrow X may be referred to as a longitudinal direction X of the sheet remover 1 or simply as the longitudinal direction X. The longitudinal direction X is a sheet insertion direction in which the sheet is inserted into the sheet remover 1.

An outer circumferential surface of the sheet remover 1 includes an outer circumferential face 14*a* of the winding guide 14. The outer circumferential face 14*a* of the winding guide 14 is a winding portion along which the sheet is wound.

An operator holds a holding part 21, which is a right portion of the sheet remover 1 in FIG. 1. Specifically, in the sheet remover 1, the holding part 21 is located to the right of a contact face 13*a* as a contact part, which is a left end of the gap formation plate 13 in FIG. 2 and a downstream end of a through part 23 in the sheet insertion direction. The pair of leading-end claws 12 is disposed at the left end of the sheet remover 1 in FIG. 1. A space between the pair of leading-end claws 12 is an insertion part 22 into which the sheet is inserted. The insertion part 22 includes an insertion port at an upstream end of the sheet remover 1 in the sheet insertion direction and a downstream portion extending downstream from the insertion port in the sheet insertion direction. The sheet is inserted into the insertion port of the insertion part 22 and further inserted downstream in the sheet insertion direction through the downstream portion. The leading-end claw 12 includes a curved leading end 12*c* having a curved surface. The leading end 12*c* is an upstream end of the leading-end claw 12 in the longitudinal direction X.

The pair of sheet holding plates 11 is disposed downstream from the pair of leading-end claws 12 in the sheet insertion direction. A space between the pair of sheet holding plates 11 is the through part 23 through which the sheet is inserted from the insertion part 22. In other words, the sheet that is inserted from the insertion part 22 passes between the pair of sheet holding plates 11 and is held between the pair of sheet holding plates 11.

The pair of sheet holding plates 11 sandwich the gap formation plate 13 therebetween away from the pair of leading-end claws 12 in the longitudinal direction X of the sheet remover 1. The through part 23 is located downstream from the insertion part 22 in the sheet insertion direction.

The sheet remover 1 has an entire length X0 in the longitudinal direction of the sheet remover 1 preferably in a range of from 500 mm to 600 mm, and more preferably, in a range of from 500 mm to 550 mm, in a case where the width of a sheet P along a direction perpendicular to a sheet conveyance direction is equal to or smaller than 13 inches (about 330 mm). Note that the sheet conveyance direction is a direction in which the sheet P is conveyed. The entire length X0 of the sheet remover 1 equal to or greater than 500 mm is sufficient for an operator to hold the holding part 21 with both hands without difficulty to hold the sheet P as appropriate and wind the sheet P. A length X3 of the through part 23 through which the sheet P is inserted and held by the sheet holding plates 11 is preferably about two-thirds or more of the width of the sheet P along the direction perpendicular to the sheet conveyance direction. The aforementioned upper limit of the entire length X0 of the sheet remover 1 limits the weight of the sheet remover 1 and enhances the operability when the operator uses the sheet remover 1. The sheet remover 1 has a diameter of about 30 mm. In the present embodiment, the entire length X0 of the sheet remover 1 is about 540 mm. A length X1 in the longitudinal direction of the sheet remover 1 between an end of the leading-end claw 12 (i.e., a longitudinal end of the sheet remover 1) and the contact face 13*a* of the gap formation plate 13 is about 340 mm. A length X2 of the holding part 21 as a distance between the contact face 13*a* and the other longitudinal end of the sheet remover 1 is about 200 mm.

According to the present embodiment, the pair of sheet holding plates 11 and the pair of leading-end claws 12 are fixed at the respective positions in the sheet remover 1 and do not perform an operation such as pinching a sheet when removing the sheet. A description of how to remove the sheet is deferred.

Figure 3:
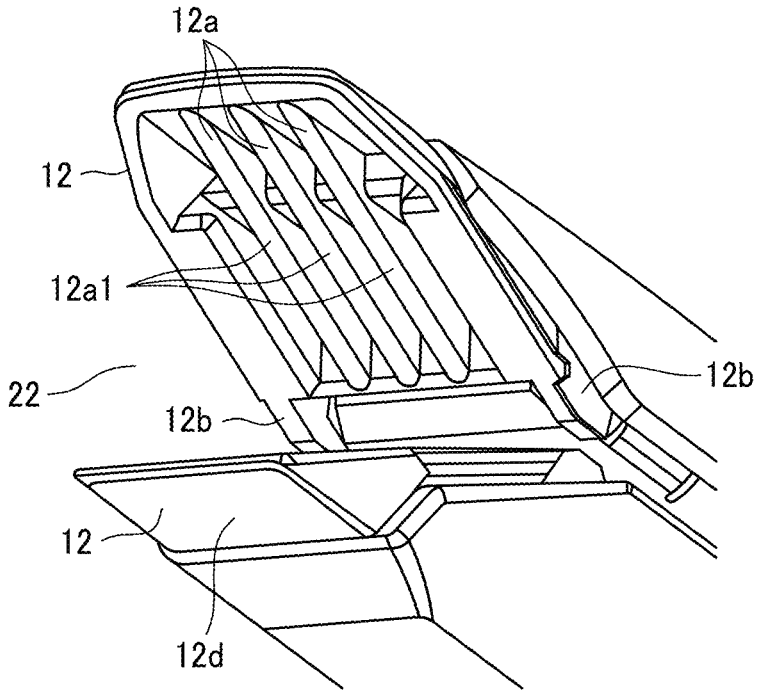
FIG. 3 is a perspective view of a leading-end claw of the sheet remover of FIG. 1.

As illustrated in FIG. 3, the leading-end claw 12 includes a plurality of ribs 12*a* extending in the longitudinal direction of the sheet remover 1. In other words, the plurality of ribs 12*a* extends in the sheet insertion direction. The plurality of ribs 12*a* includes a plurality of guide faces 12*al* inclined toward the through part 23 in the sheet insertion direction. The plurality of guide faces 12*a*1 guides the sheet inserted into the insertion part 22 toward the through part 23 in the sheet insertion direction. The leading-end claw 12 is in a bilaterally symmetrical shape with respect to the central axis of the sheet remover 1, which is an axis parallel to the longitudinal direction of the sheet remover 1 and passing through the center in the width direction of the leading-end claw 12.

Figure 4:
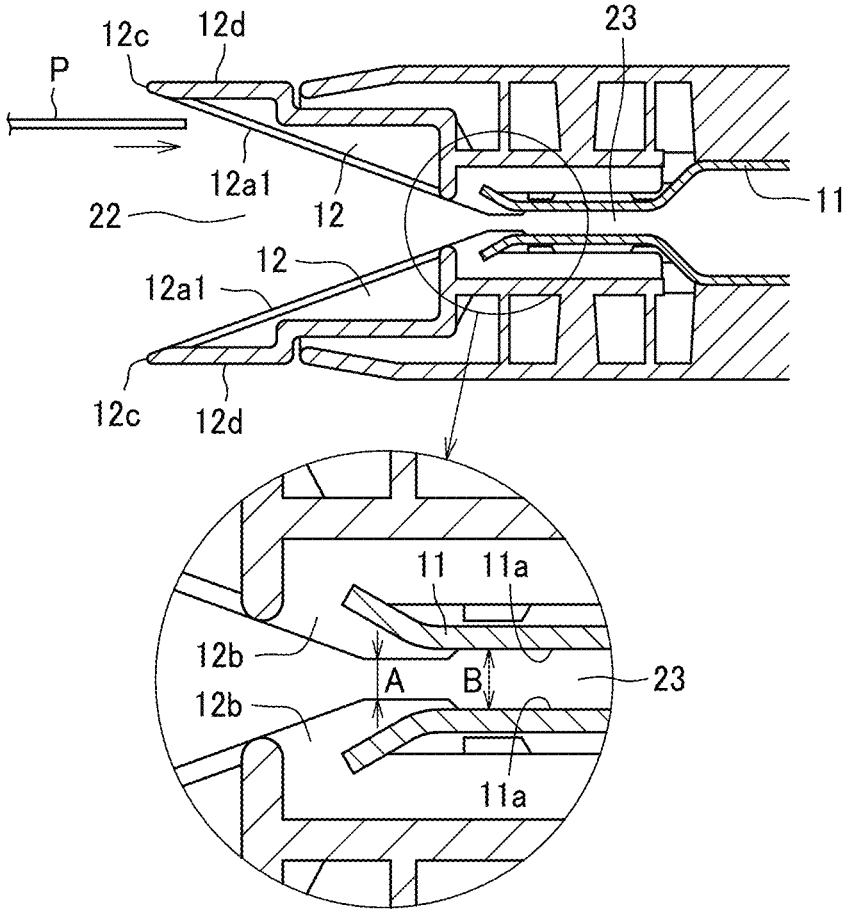
FIG. 4 is a partial cross-sectional view of the sheet remover of FIG. 1.

As illustrated in FIG. 4, the interval between the leading-end claws 12 decreases rightward in FIG. 1. In other words, the length of the insertion part 22 in the thickness direction of the sheet that is inserted, which is the vertical direction in FIG. 4, decreases toward the back of the sheet remover 1. The pair of sheet holding plates 11 that is located behind the insertion part 22 has a gap with a width B therebetween, as illustrated in the enlarged view of FIG. 4.

The gap with the width B is the through part 23. The leading end 12*c* as the upstream end of the leading-end claw 12 in the sheet insertion direction has a curved surface.

As illustrated in FIG. 3, the leading-end claw 12 includes a projection 12*b* at each end in the width direction of the leading-end claw 12. As illustrated in the enlarged view of FIG. 4, the projection 12*b* projects toward the sheet, in other words, toward the vertical center of the sheet remover 1 in FIG. 4, beyond a sheet holding face 11*a* of the sheet holding plate 11. In other words, a width A of a gap between the projections 12*b* is smaller than the width B of the gap between the sheet holding faces 11*a* of the sheet holding plates 11. In other words, each of the pair of leading-end claws 12 includes, at opposed ends in the width direction of each of the pair of leading-end claws 12, portions that narrow the gap between the leading-end claws 12. The portions that narrow the gap function as portions that prevent the sheet inserted through the through part 23 from coming off leftward in FIG. 4. The projection 12*b* projecting toward the sheet beyond the sheet holding face 11*a* smoothly delivers the sheet from the leading-end claw 12 to the sheet holding plate 11. The sheet holding face 11*a* is planar, parallel to the longitudinal direction X.

Referring now to FIGS. 5A to 7B, a description is given of an opening and closing configuration in a conveying device in which a sheet is jammed.

In the following description, the sheet P is described as an example of the sheet serving as a recording medium. The sheet or recording medium that is removed by the sheet remover according to the embodiments of the present disclosure is not limited to the sheet P. Examples of the recording medium include, but are not limited to, the sheet P as a sheet of plain paper, thick paper, a postcard, an envelope, thin paper, coated paper such as art paper, tracing paper, an overhead projector (OHP) transparency, a plastic film, a prepreg, and a copper foil.

FIGS. 5A to 6B are diagrams illustrating the sheet P jammed on the way along a conveyance passage 91 in a conveying device 90.

Figure 5A:
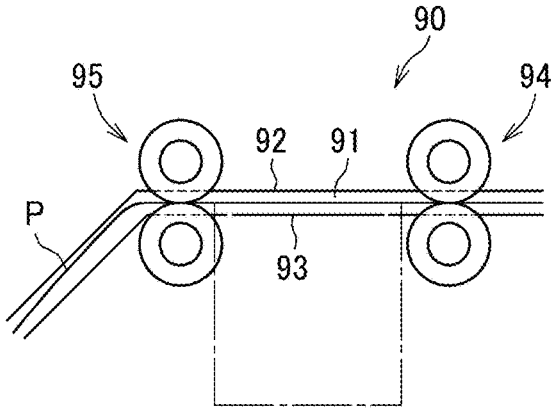
FIGS. 5A and 5B are plan views of an example conveyance passage.
Figure 6A:
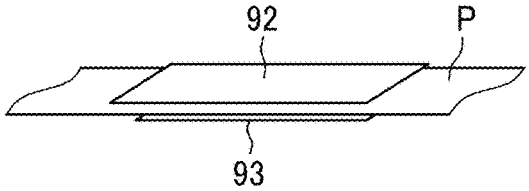
FIGS. 6A and 6B are perspective views of the conveyance passage of FIGS. 5A and 5B.

As illustrated in FIGS. 5A and 6A, the conveyance passage 91 is defined by a pair of conveyance guide plates 92 and 93 as a pair of conveyance passage formers. In other words, a gap between the conveyance guide plates 92 and 93 is part of the conveyance passage 91 through which the sheet P is conveyed. The conveyance guide plate 93 can be opened and closed by access from the outside.

As illustrated in FIG. 5A, the sheet P is jammed while being sandwiched at an area of contact, which may be called a nip, between rollers of a conveyance roller pair 94 and at an area of contact (i.e., nip) between rollers of a conveyance roller pair 95. The conveyance roller pairs 94 and 95 are aligned as upstream and downstream conveyance roller pairs along the conveyance passage 91 as illustrated in FIG. 5A.

Figure 5B:
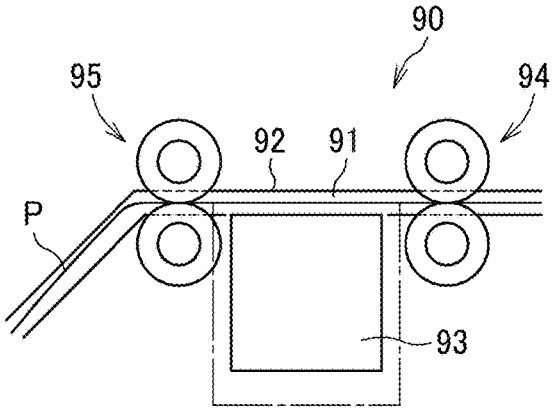
Figure 6B:
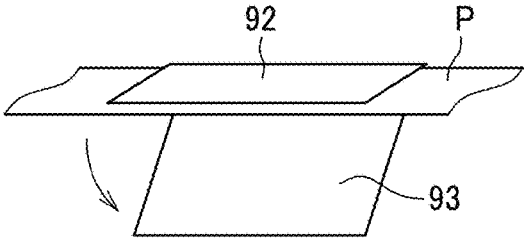

When the conveyance guide plate 93 that is accessible from the outside of the conveying device 90 is opened from the state illustrated in FIG. 5A to the state illustrated in FIG. 5B, a part of the conveyance passage 91 becomes open to the outside of the conveying device 90 as illustrated in FIGS. 5B and 6B.

The sheet remover 1 is inserted into the conveying device 90 from the opened space to remove the jammed sheet P to the outside of the conveying device 90.

Figure 7A:
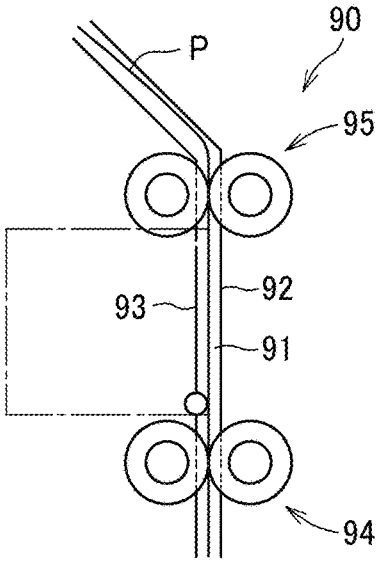
FIGS. 7A and 7B are plan views of a conveyance passage different from the conveyance passage of FIGS. 5A and 5B.
Figure 7B:
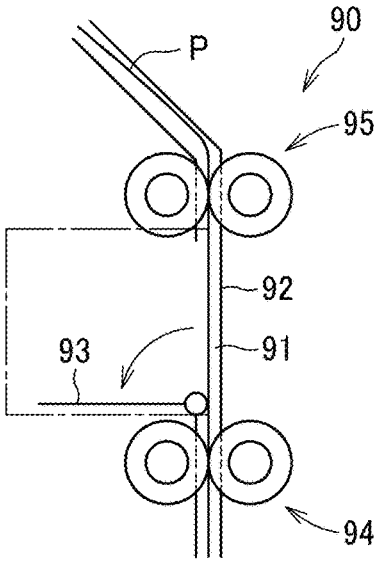

Although FIGS. 5A to 6B illustrate a case where the shaft of the conveyance guide plate 92 is parallel to the sheet conveyance direction, the shaft of the conveyance guide plate 92 may be perpendicular to the sheet conveyance direction as illustrated in FIGS. 7A and 7B.

Now, a detailed description is given of how to wind and remove a sheet with the sheet remover 1 described above.

Figure 8:
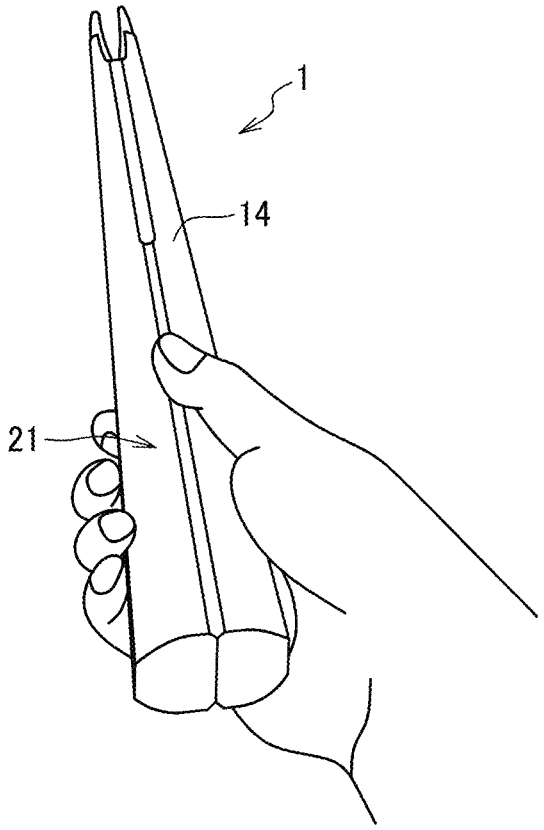
FIG. 8 is a view of the sheet remover of FIG. 1 gripped.
Figure 9:
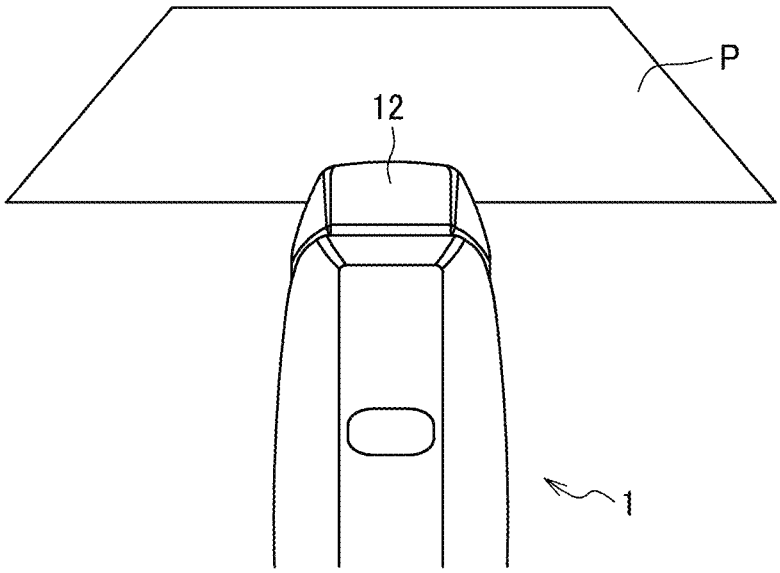
FIG. 9 is a view of a sheet inserted in the sheet remover of FIG. 1.

First, as illustrated in FIG. 8, an operator holds the holding part 21 of the sheet remover 1. Then, as illustrated in FIG. 9, the pair of leading-end claws 12 of the sheet remover 1 is brought close to the sheet P to insert the sheet P into the insertion part 22 between the leading-end claws 12 as illustrated in FIG. 4. At this time, since the leading end 12*c* of the leading-end claw 12 has a curved surface, the sheet P is guided in the insertion part 22 in the sheet insertion direction without being caught when the leading end of the sheet P abuts against the leading end 12*c*.

The leading end of the sheet P that has been inserted into the insertion part 22 as illustrated in FIG. 4 is guided by the plurality of guide faces 12*al* of the leading-end claw 12 to relatively move to the back of the insertion part 22 and be inserted into the through part 23. With such a shape of the insertion part 22 in which the gap between the leading-end claws 12 gradually narrows, the sheet remover 1 smoothly guides the leading end of the sheet P that has been inserted into the insertion part 22 to the through part 23. In other words, simply by inserting the leading end of the sheet P into the insertion part 22 and moving the sheet remover 1 toward the sheet P, the operator can insert the sheet P through the through part 23. At this time, the projection 12*b* projecting toward the sheet P beyond the sheet holding face 11*a* smoothly delivers the sheet P from the leading-end claw 12 to the sheet holding plate 11.

Since the leading-end claws 12 are in a bilaterally symmetrical shape with respect to the central axis of the sheet remover 1 as illustrated in FIG. 3, the force is applied laterally equally to the sheet P inserted into the insertion part 22 with respect to the central axis of the sheet remover 1. Thus, the sheet P is prevented from being inclined and is smoothly guided to the through part 23.

As illustrated in FIG. 2, the contact face 13*a* of the gap formation plate 13 is located at a longitudinal end of the through part 23. The operator moves the sheet remover 1 toward the sheet P until the leading end of the sheet P contacts the contact face 13*a*.

As the gap formation plate 13 is sandwiched between the sheet holding plates 11, a gap is formed between the sheet holding plates 11. In other words, in the present embodiment, the width B of the through part 23, which is illustrated in FIG. 4 as the gap between the sheet holding faces 11*a* of the sheet holding plates 11, is specified by the thicknesses of the gap formation plate 13. The width B is greater than the maximum thickness of a sheet that is handled by the sheet remover 1. Accordingly, even a sheet having the maximum thickness is smoothly inserted into the through part 23.

Figure 10:
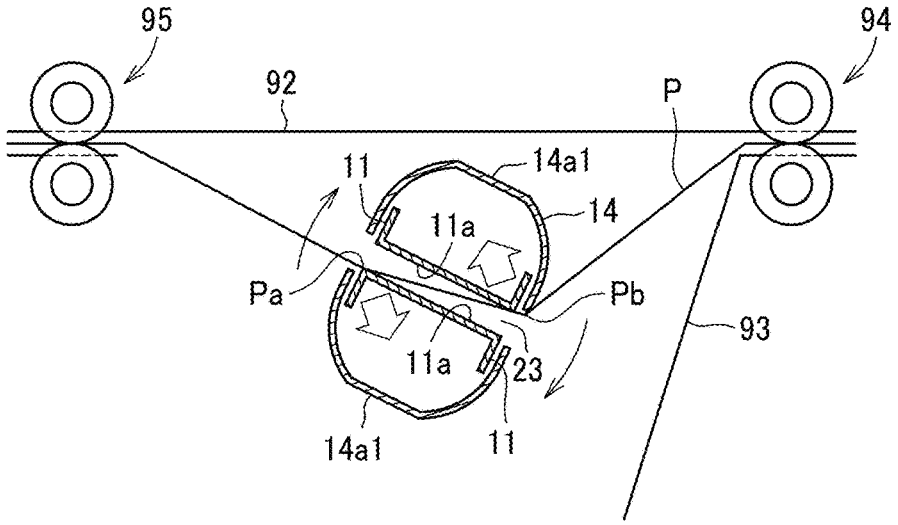
FIG. 10 is a cross-sectional view of the sheet remover of FIG. 1 before winding a sheet.
Figure 11:
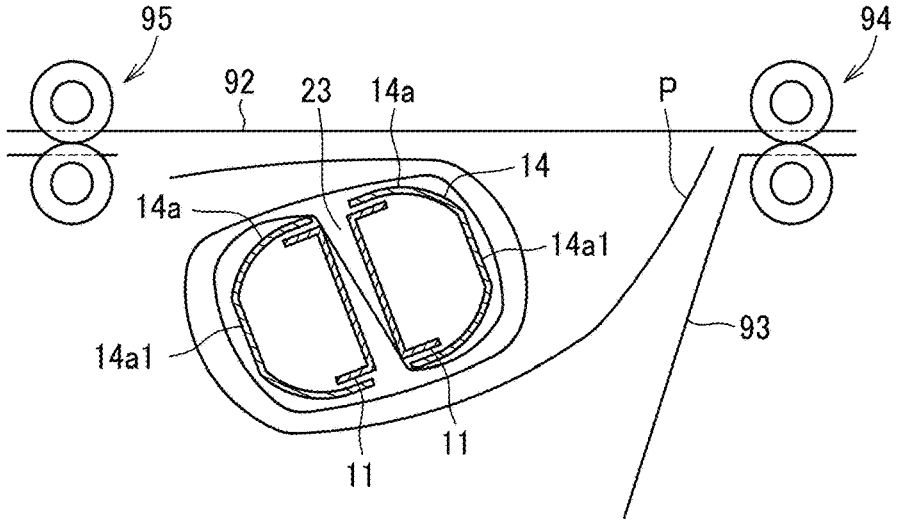
FIG. 11 is a cross-sectional view of the sheet remover of FIG. 1 after winding the sheet.

After bringing the leading end of the sheet P into contact with the contact face 13*a* of the gap formation plate 13, the operator rotates the sheet remover 1 as indicated by arrows in FIG. 10 while holding the holding part 21. At the initial stage of the rotation, the sheet P contacts the lateral ends of the sheet holding plates 11 or the side of the winding guide 14 at two portions Pa and Pb. Since the positions of the portions Pa and Pb are fixed with respect to the sheet remover 1 by the rigidity of the sheet P, the sheet P hardly falls off from the sheet remover 1 when the sheet remover 1 rotates. By rotating the sheet remover 1, the operator winds the sheet P around the outer circumferential face 14*a* of the winding guide 14 as illustrated in FIG. 11. Note that FIGS. 10 and 11 simplify the shapes of the sheet holding plate 11 and the winding guide 14.

As the sheet P is wound up, the sheet P is pulled out from the nip between the conveyance roller pair 94 and the nip between the conveyance roller pair 95. Thus, the leading and trailing ends of the sheet P in the sheet conveyance direction are accommodated in the space that is open to the outside as the conveyance guide plate 93 is opened. In this state, the operator moves the sheet remover 1 in a direction perpendicular to the surface of the paper on which FIG. 11 is drawn, opposite to the direction in which the sheet remover 1 is inserted, to remove the sheet P wound around the sheet remover 1 to the outside of the conveying device 90.

As described above, the sheet remover according to the present embodiment includes an insertion part and a through part that is located downstream from the insertion part in the sheet insertion direction. When an operator simply moves the sheet remover toward a sheet (e.g., sheet P) so that the sheet is inserted into the sheet remover, the sheet is inserted into the through part via the insertion part. Thus, the operator can easily remove the sheet from a device such as a conveying device. Since the operator does not have to touch the sheet or the position where the sheet is jammed in the device by hand, the hand of the operator does not get dirty or is not injured by touching, for example, a sheet metal. In addition, for example, when removing the sheet that has passed through a heating device such as a fixing device, the operator can remove the sheet without touching the heated sheet by hand.

In particular, since the sheet remover of the present embodiment does not require an operation such as opening and closing the sheet remover to hold the sheet in the sheet remover, the operator can remove the sheet in a narrower space with the sheet remover of the present embodiment, as compared with a typical sheet remover that is to be opened and closed to hold the sheet. For this reason, the sheet remover of the present embodiment can be used at increased places as compared with the typical sheet remover. In addition, the sheet remover of the present embodiment facilitates the removal of sheets and enhances the user-friendliness of the sheet remover.

Further, the sheet remover of the present embodiment is disposed as a separate component independent of a device such as a conveying device in which a sheet is jammed. Thus, for example, as compared with a sheet remover that is fixed to the conveying device, the sheet remover of the present embodiment can be used at any place into which the sheet remover can be inserted as described above. Thus, the user-friendliness of the sheet remover is enhanced. Since a plurality of sheet removers does not have to be disposed for a plurality of positions where a sheet is jammed, the present embodiment reduces the cost of a device such as a conveying device.

In particular, the sheet remover of the present embodiment includes a winding guide at the outer circumferential surface of the sheet remover. Specifically, in the present embodiment, the operator rotates the sheet remover while keeping the sheet inserted in the through part to wind the sheet and remove the sheet to the outside of the device. Thus, the operator can easily remove the sheet even when the sheet is sandwiched between a conveyance roller pair. If the operator removes the sheet sandwiched between the conveying roller pair with a hand, the operator needs to pull and remove the sheet by hand or wind up the sheet by hand and remove the sheet from the nip between rollers of the conveyance roller pair. However, when the operator pulls and removes the sheet by hand, the operator may have some difficulties in pulling and removing the sheet or may bump the hand in a relatively narrow space in the device. When the operator winds the sheet by hand and removes the sheet from the nip between the rollers of the conveyance roller pair, the operator may have some difficulties in winding and removing the sheet in a relatively narrow space in the device. In addition, since the sheet can be rotated by only 180 degrees each time by hand, it takes time to wind the sheet that is relatively long in the sheet conveyance direction. By contrast, the sheet remover 1 of the present embodiment allows the operator to easily remove the sheet in a narrower space, as compared with a case where the operator removes the sheet by hand.

The sheet remover of the present embodiment is shaped like a rod extending in the longitudinal direction of the sheet remover parallel to the direction in which the sheet remover is inserted into a device such as a conveying device and the direction in which a sheet is inserted into the sheet remover. The rod shape of the sheet remover decreases a cross-sectional area perpendicular to the longitudinal direction of the sheet remover and allows the sheet remover to be inserted into a relatively narrow space. For example, as illustrated in FIG. 8, the cross-sectional area perpendicular to the longitudinal direction of the sheet remover according to the present embodiment is significantly smaller than the size of a human hand. For this reason, the operator can insert the sheet remover even into a narrow place where inserting a hand is difficult and remove a sheet. Thus, the sheet remover of the present embodiment enhances the user-friendliness for the operator to remove the sheet.

As illustrated in FIG. 3 or FIG. 4, an outer circumferential face 12*d* of the leading-end claw 12 is planar, parallel to the longitudinal direction of the sheet remover 1, which is the lateral direction in FIG. 4. In other words, the outer circumferential surface of the sheet remover 1 includes a planar portion at the leading end of the sheet remover 1 adjacent to the insertion part 22, more specifically, at a position around the insertion part 22 in the longitudinal direction of the sheet remover 1. When the sheet that is jammed in the conveying device is in close contact with one of the conveyance guide plates (for example, the conveyance guide plate 92 illustrated in FIG. 10), the operator inserts the leading end of the sheet remover 1 between the conveyance guide plate and the sheet while keeping the outer circumferential surface at the leading end of the sheet remover 1 in contact with the conveyance guide plate. At this time, since the planar outer circumferential face 12*d* is hardly caught by the conveyance guide plate, the sheet is smoothly inserted into the insertion part 22 and the through part 23.

As illustrated in FIG. 11, the outer circumferential face 14*a* of the winding guide 14 as a part of the outer circumferential surface of the sheet remover 1 according to the present embodiment has a planar portion 14*al* resulting from cutting off a part of an ellipse. Since the outer circumferential surface of the sheet remover 1 includes a planar portion extending in the longitudinal direction of the sheet remover 1 at a position not around the insertion part 22 (i.e., a position other than the position around the insertion part 22) in the longitudinal direction of the sheet remover 1, the sheet remover 1 can be placed at a given position on a placement surface of, for example, a conveying device.

In the cross-section of the winding guide 14 in the direction perpendicular to the sheet insertion direction illustrated in FIG. 11, diagonal portions of the outer circumferential face 14*a* of the winding guide 14 are curved. Particularly, in the present embodiment, four corners of the outer circumferential face 14*a* are curved. Such a shape of the winding guide 14 increases the winding angle of the sheet P and facilitates the winding of the sheet P, as compared with a case where the four corners are right angles. In the present embodiment, the shape of the outer circumferential face 14*a* of the winding guide 14 is not a circular shape but an elliptical shape having a long diameter portion and a short diameter portion. Such a shape of the winding guide 14 allows an operator to easily hold the sheet remover 1 and enhances the workability.

The contact face 13*a* of the gap formation plate 13 is a surface perpendicular to the longitudinal direction X. When the leading end of a sheet (e.g., sheet P) contacts the contact face 13*a*, the posture and inclination of the sheet with respect to the sheet remover 1 is corrected. Since the correction of the inclination of the sheet prevents distortion of the sheet while the sheet is wound, the operator easily winds the sheet around the winding guide 14. However, the operator does not always have to insert the sheet into the sheet remover 1 until the leading end of the sheet contacts the contact face 13*a*. For example, when there is no sufficient space for inserting the sheet remover 1 into an open space of a device such as a conveying device, the operator may wind the sheet with the sheet remover 1 while the leading end of the sheet is not in contact with the contact face 13*a*.

When the sheet remover 1 winds the sheet, the entire width between opposed ends of the sheet in the sheet insertion direction does not have to be accommodated in the through part 23 and the insertion part 22 of the sheet remover 1. In other words, even when apart of the sheet is outside the sheet remover 1, the part of the sheet outside the sheet remover 1 is wound as the sheet in the sheet remover 1 is wound. For example, the sheet remover 1 can wind a sheet having a length 1.5 times the length X1 between the end of the leading-end claw 12 and the contact face 13*a* of the gap formation plate 13 of the sheet remover 1 illustrated in FIG. 2. The length X1 is preferably equal to or less than the sum of half the length of the conveyance passage in the width direction of the sheet at a position where the sheet is jammed and half the width of the sheet. Accordingly, the sheet can be inserted to the back of the through part 23 so that the leading end of the sheet can contact the contact face 13*a* as appropriate.

Figure 12:
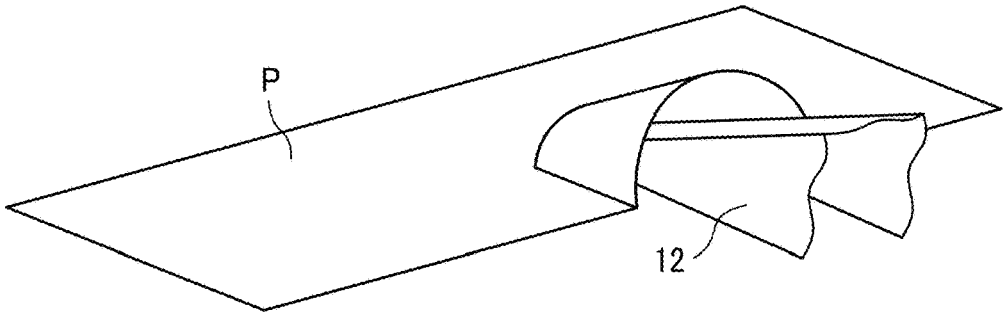
FIG. 12 is a perspective view of a sheet bent by a leading-end claw according to an embodiment of the present disclosure.
Figure 13:
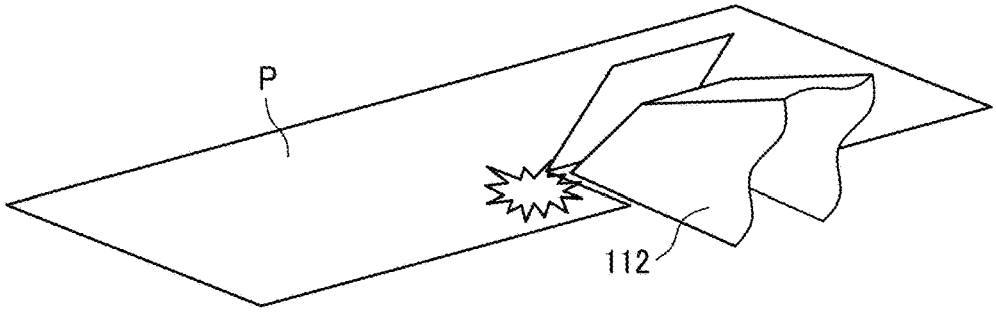
FIG. 13 is a perspective view of a sheet bent by a leading-end claw according to a comparative example.

As illustrated in FIG. 2, a cross-sectional area of a portion corresponding to the leading-end claw 12 in the longitudinal direction X of the sheet remover 1 gradually increases toward the through part 23. Accordingly, as illustrated in FIG. 12, the sheet P that is inserted in the insertion part 22 of the sheet remover 1 gradually decreases in bending from the leading end of the leading-end claw 12. By contrast, in a case where the sheet P is inserted between leading-end claws 112 having a cross-sectional shape in rapid increase as illustrated in FIG. 13, the difference in bending becomes too large between a portion of the sheet P inserted in the insertion part 22 and a portion of the sheet P not inserted in the insertion part 22. As a result, the sheet P may be broken. If the sheet P is broken, a piece of the sheet P may remain in the conveying device. The above-described configuration of the present embodiment prevents the breakage of the sheet. In particular, an angle α (see FIG. 1) of the end of the leading-end claw 12 with respect to the longitudinal direction X is preferably equal to or smaller than 13.5 degrees. In this case, the sheet remover 1 smoothly scoops the sheet P regardless of the thickness of the sheet P and prevents the sheet P from being broken as illustrated in FIG. 13.

Note that FIGS. 12 and 13 simplify the shape of the leading-end claws 12.

According to the present embodiment, the cross-sectional shape, perpendicular to the longitudinal direction of the sheet remover 1, of a portion including the through part 23 of the sheet remover 1 in the longitudinal direction of the sheet remover 1 is substantially the same along the longitudinal direction of the sheet remover 1. Accordingly, the operator can easily wind the sheet with the sheet remover 1.

Figure 14A:
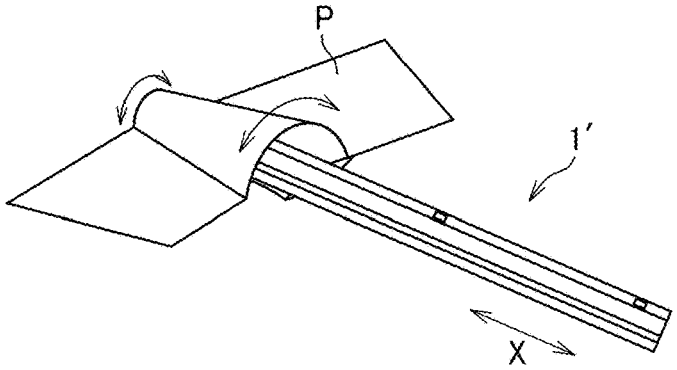
FIG. 14A is a perspective view of a sheet remover winding a sheet, according to another comparative example.
Figure 14B:
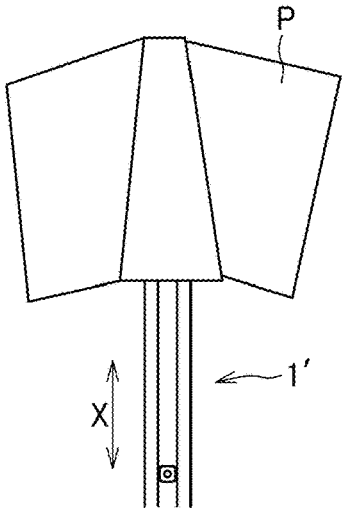
FIG. 14B is a plan view of the sheet remover of FIG. 14A.

FIGS. 14A and 14B illustrate a sheet remover 1' according to another comparative example.

The sheet remover 1' includes a cross-sectional area gradually increasing from a leading-end claw to the back of the sheet remover 1'. When the sheet remover 1' having such a shape winds the sheet P, the sheet P is twisted in the longitudinal direction X as illustrated in FIG. 14B. For this reason, a greater force is required in this case, as compared with the embodiment described above.

Figure 15A:
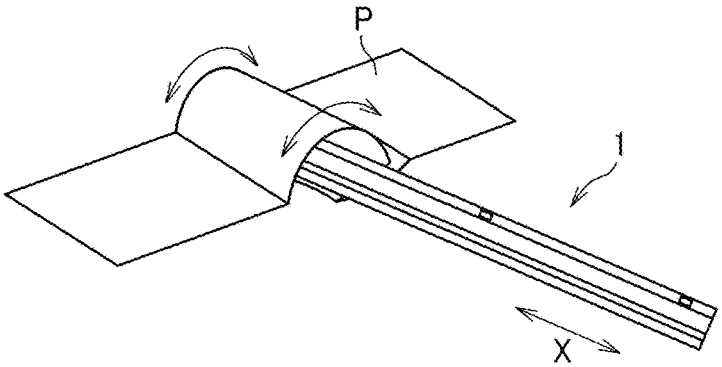
FIG. 15A is a perspective view of a sheet remover winding a sheet, according to an embodiment of the present disclosure.
Figure 15B:
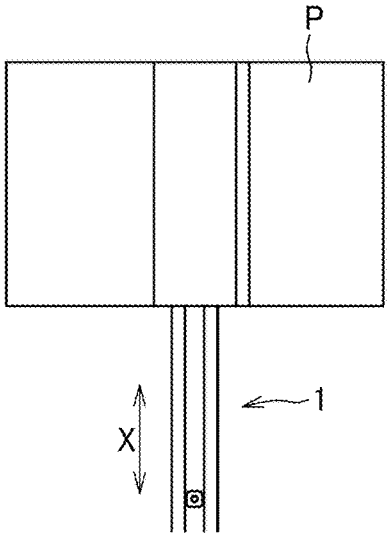
FIG. 15B is a plan view of the sheet remover of FIG. 15A.

FIGS. 15A and 15B illustrate the sheet remover 1 according to the present embodiment.

Unlike the sheet remover 1' described above, the sheet remover 1 does not twist the sheet P in the longitudinal direction X due to the above-described shape when winding the sheet P, as illustrated in FIG. 15B. Thus, the operator can easily wind the sheet with the sheet remover 1.

Now, a description is given of an image forming apparatus that includes a conveying device and the sheet remover 1 described above.

The image forming apparatus according to the present embodiment includes a storage 200 for accommodating the sheet remover 1. Alternatively, the sheet remover 1 may be attached to the image forming apparatus or may be placed on a given planar surface of the image forming apparatus without a dedicated portion for accommodating or attaching the sheet remover 1.

Figure 16:
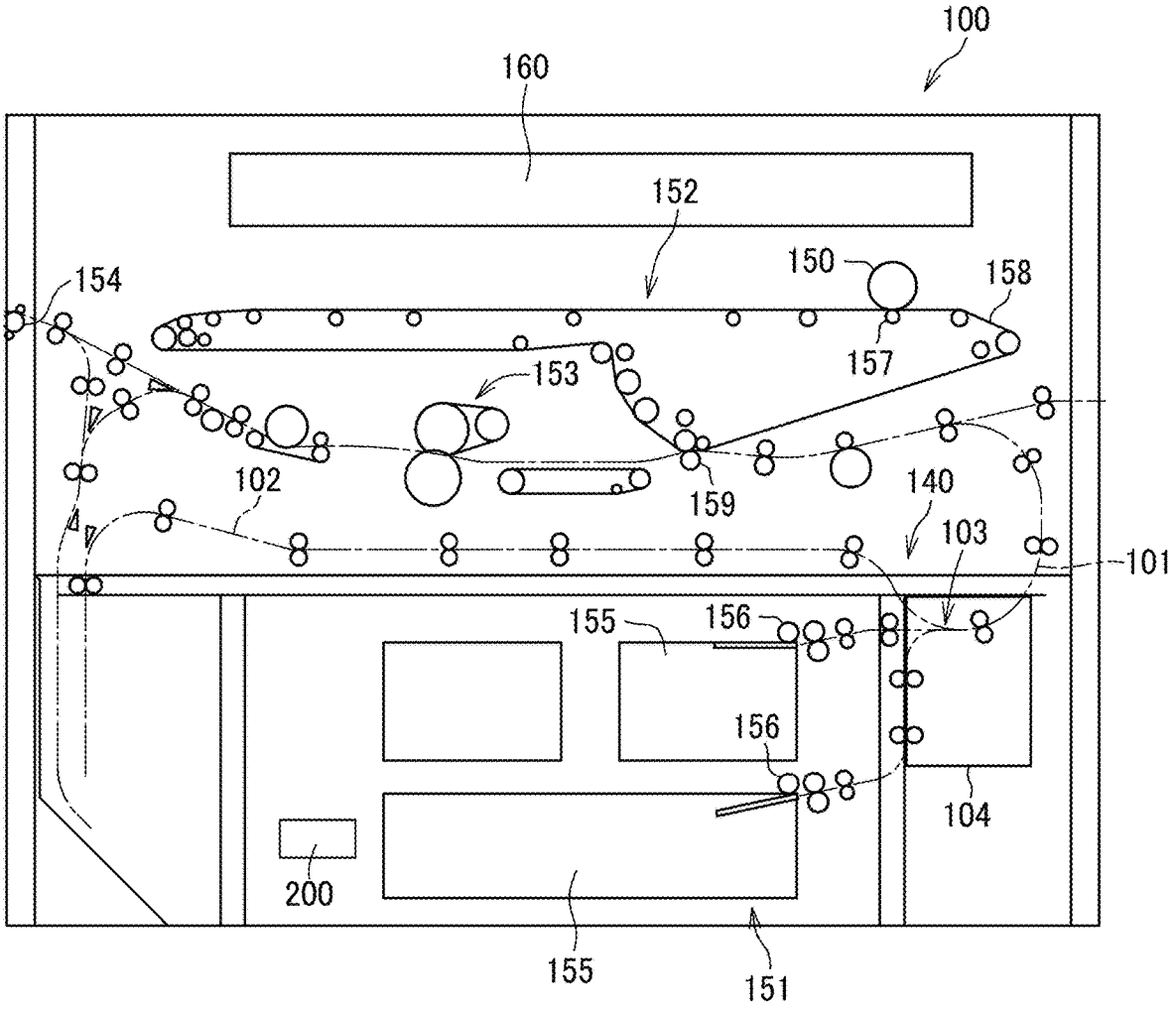
FIG. 16 is a schematic diagram illustrating a configuration of an image forming apparatus according to an embodiment of the present disclosure.

As illustrated in FIG. 16, an image forming apparatus 100 includes, for example, a photoconductor 150, an exposure device 160, a sheet feeding device 151, a conveying device 140, a transfer device 152, a fixing device 153, and an output roller 154.

The sheet feeding device 151 includes a plurality of input trays 155 and a plurality of sheet feeding rollers 156. The sheet feeding roller 156 feeds the sheet P from the corresponding input tray 155 to a conveyance passage 101.

A plurality of conveyance roller pairs are disposed along the conveyance passage 101 and a reverse conveyance passage 102.

The transfer device 152 includes, for example, a primary transfer roller 157, an intermediate transfer belt 158, and a secondary transfer roller 159. A primary transfer nip is formed between the photoconductor 150 and the primary transfer roller 157. A secondary transfer nip is formed between the intermediate transfer belt 158 and the secondary transfer roller 159. A toner image is transferred from the photoconductor 150 onto the intermediate transfer belt 158 at the primary transfer nip.

The sheet P that has been fed from the sheet feeding device 151 to the conveyance passage 101 is conveyed downstream in the sheet conveyance direction, by a plurality of conveyance roller pairs disposed in the conveying device 140, to the secondary transfer nip. After the toner image is transferred onto the sheet P at the secondary transfer nip, the image on the sheet P is fixed by the fixing device 153. The sheet P bearing the fixed image is further conveyed downstream in the sheet conveyance direction and ejected to the outside of the image forming apparatus 100 by the output roller 154.

When images are to be formed on both sides of the sheet P, the sheet P is conveyed to the reverse conveyance passage 102 at a position downstream from the fixing device 153 in the sheet conveyance direction. On the reverse conveyance passage 102, the front and back sides of the sheet P are reversed. Then, the sheet P is conveyed to the conveying device 140 again so that another image is formed on the back side of the sheet P in the same manner as the front side of the sheet P. The sheet P bearing images on both sides of the sheet P is ejected to the outside of the image forming apparatus 100 by the output roller 154.

As an example, the conveying device 140 according to the present embodiment includes a merging portion 103 at which the reverse conveyance passage 102 merges with the conveyance passage 101, at a position on the conveyance passage 101 upstream from the second transfer nip in the sheet conveyance direction.

When a door 104 on a housing of the image forming apparatus 100 is opened to the front side of the paper on which FIG. 16 is drawn, the merging portion 103 and the surrounding area of the merging portion 103 become open to the outside of the image forming apparatus 100. Then, the sheet remover 1 according to the present embodiment can remove the sheet P jammed at the merging portion 103 or in the surrounding area of the merging portion 103. The sheet remover 1 according to the present embodiment may remove the sheet P jammed at a position other than the merging portion 103 or the surrounding area of the merging portion 103 in the image forming apparatus 100. For example, the sheet remover 1 may remove the sheet P jammed at a position downstream from the fixing device 153 in the sheet conveyance direction. The conveying device 140, which conveys the sheet P that may be jammed and removed by the sheet remover 1 of the present embodiment, is a device that includes a conveyance roller pair on the conveyance passage 101 or the reverse conveyance passage 102 in the image forming apparatus 100 and may be an appropriate part or all of the device. The entire image forming apparatus 100 may be a conveying device.

Figure 17A:
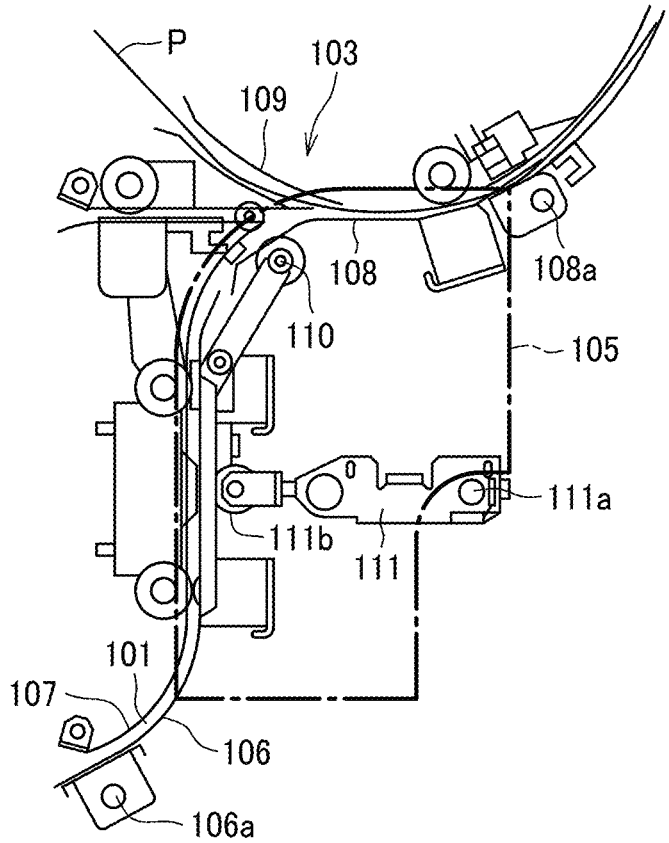
FIGS. 17A and 17B are diagrams illustrating a configuration of an opening and closing portion of the image forming apparatus of FIG. 16.

When the door 104 is opened, as illustrated in FIG. 17A, the merging portion 103 and part of the conveyance passage 101 and the reverse conveyance passage 102 around the merging portion 103 become open to the outside of the image forming apparatus 100 via an opening 105 of the housing of the image forming apparatus 100. Specifically, FIG. 17A illustrates a range surrounded by the one-dot chain line as the opening 105 that is opened to the outside of the image forming apparatus 100. For example, an operator accesses the limited space to remove the jammed sheet P.

A part of the conveyance passage 101 is defined by conveyance guide plates 106 and 107 as conveyance passage formers. Another part of the conveyance passage 101 including the merging portion 103 is defined by a conveyance guide plate 109 and a conveyance guide plate 108 that is continuous to the conveyance guide plate 106. The conveyance guide plates 108 and 109 serve as conveyance passage formers.

The conveyance guide plate 106 is rotatable about a rotary shaft 106*a*. The conveyance guide plate 108 is rotatable about a rotary shaft 108*a*. A restraint 110 is attached to the conveyance guide plate 106. When the conveyance guide plate 106 is closed as illustrated in FIG. 17A, the restraint 110 contacts the conveyance guide plate 108 and restrains the conveyance guide plate 108 to be closed.

A restraint lever 111 is disposed to restrain the conveyance guide plate 106 to be closed. The restraint lever 111 includes a rotary shaft 111*a* and a restraint portion 111*b*. The rotary shaft 111*a* is fixed to the housing of the image forming apparatus 100. The restraint lever 111 is rotatable about the rotary shaft 111*a*.

Figure 17B:
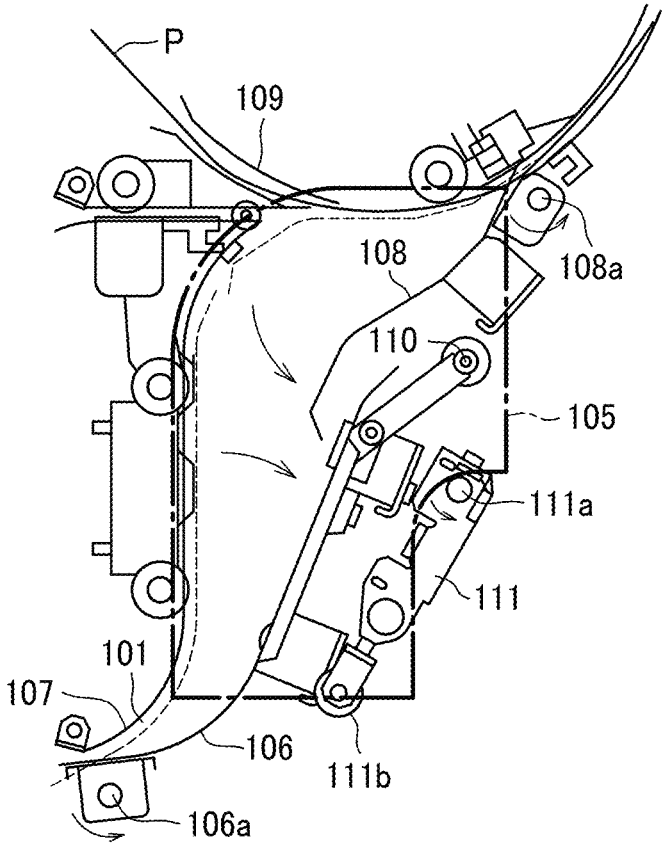

In FIG. 17A, the restraint portion 111*b* is in contact with the conveyance guide plate 106 and restrains the conveyance guide plate 106 to be closed. In this state, when the restraint lever 111 is rotated about the rotary shaft 111*a*, the restraint portion 111*b* is separated from the conveyance guide plate 106. Thus, the conveyance guide plate 106 is released from the restraint by the restraint portion 111*b*. As a result, as illustrated in FIG. 17B, the conveyance guide plate 106 rotates about the rotary shaft 106*a* by the weight of the conveyance guide plate 106 and opens the conveyance passage between the conveyance guide plates 106 and 107. The rotation of the conveyance guide plate 106 separates the restraint 110 from the conveyance guide plate 108. As a result, the conveyance guide plate 108 rotates about the rotary shaft 108*a* and opens the conveyance passage between the conveyance guide plates 108 and 109.

After the conveyance passage between the conveyance guide plates 106 and 107 and the conveyance passage between the conveyance guide plates 108 and 109 are thus opened, the above-described sheet remover 1 enters from the opening 105 and is inserted between the conveyance guide plates 106 and 107 or between the conveyance guide plates 108 and 109. Then, the sheet remover 1 removes the sheet P jammed in the conveying device 140.

In the present embodiment, the opening 105 and the conveyance guide plate 107 or the conveyance guide plate 109 are arranged such that the sheet remover 1 can contact the conveyance guide plate 107 or the conveyance guide plate 109 through the opening 105. Note that both the conveyance guide plate 107 and the conveyance guide plate 109 are not opened or closed. When the operator removes the sheet P with the sheet remover 1, such an arrangement allows the operator to insert one of the pair of leading-end claws 12 between the sheet P and the conveyance guide plate 107 or the conveyance guide plate 109 while bringing the leading end of the sheet remover 1 into contact with the conveyance guide plate 107 or the conveyance guide plate 109, to insert the leading end of the sheet P into the insertion part 22 of the sheet remover 1.

A sheet detector may be disposed to detect the sheet P at a position on a conveyance passage that is accessible through an opened door. The sheet detector detects jamming of the sheet P. According to the detection, a notifier provides information that the sheet P is jammed at the position accessible through the opened door. As the notifier, for example, a light emitting element such as a light emitting diode (LED) may be disposed near an opening and closing guide. Alternatively, such information may be notified through an operation screen of the image forming apparatus 100.

In a configuration in which the sheet P is sandwiched between rollers of upstream and downstream conveyance roller pairs disposed along a conveyance passage and temporarily stopped and in which a door is disposed near the position where the sheet P is temporarily stopped such that the position can be accessed, the sheet P is preferably stopped at a position beyond the downstream conveyance roller pair in the sheet conveyance direction. When the sheet P is stopped at the position beyond the downstream conveyance roller pair in the sheet conveyance direction, the sheet P is sandwiched between the rollers of the upstream and downstream roller pairs disposed along the conveyance passage. Accordingly, the sheet P is easily inserted into the insertion part 22 of the sheet remover 1.

Figure 20:
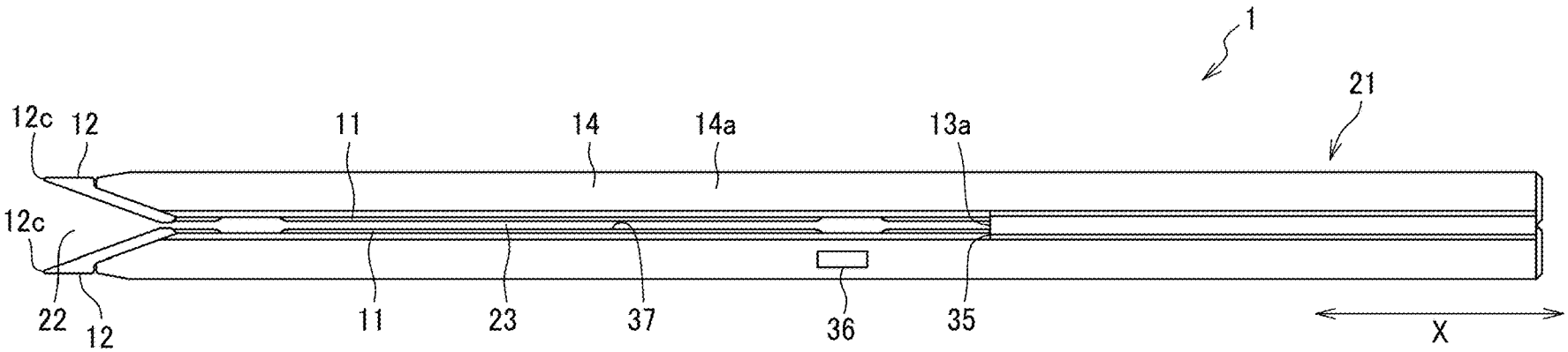
FIG. 20 is a view of a sheet remover according to a modification of the above embodiments.
Figure 21:
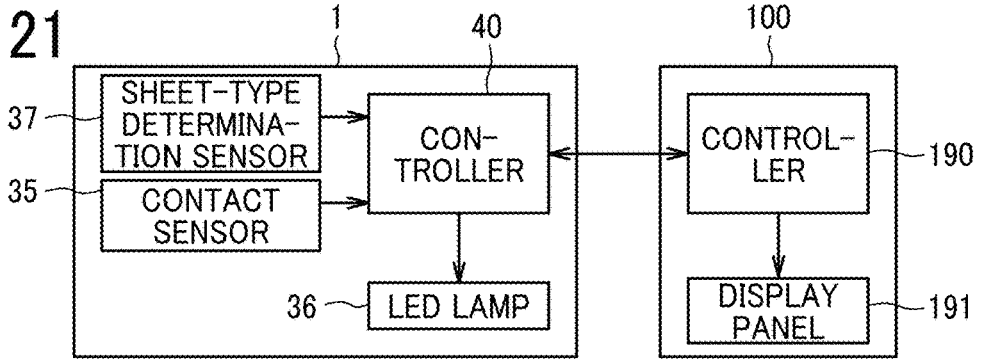
FIG. 21 is a block diagram illustrating a control configuration of the sheet remover of FIG. 20.

Referring now to FIGS. 20 and 21, a description is given of a sheet remover according to a modification of the embodiments described above.

The sheet remover according to the present modification enhances usability when an operator, particularly, a general user uses the sheet remover.

As illustrated in FIG. 20, the sheet remover 1 includes a contact sensor 35 on the contact face 13*a* of the gap formation plate 13 and a sheet-type determination sensor 37 on the sheet holding plate 11. The sheet remover 1 further includes an LED lamp 36 as a light on the outer circumferential surface of the sheet remover 1.

The detection state of the contact sensor 35 is changed when the sheet P contacts the contact face 13*a*. Thus, the contact sensor 35 detects that the sheet P is in contact with the contact face 13*a*. As illustrated in FIG. 21, when a change in the detection state of the contact sensor 35 is transmitted to a controller 40 of the sheet remover 1, the controller 40 turns on the LED lamp 36. Accordingly, an operator ascertains that the sheet P has been inserted into the back of the sheet remover 1 and winds the sheet P as appropriate to remove the sheet P from the image forming apparatus 100. Instead of or in addition to the lighting of the LED lamp 36, the sheet remover 1 may notify the operator by sound that the sheet P has been inserted into the back of the sheet remover 1.

The sheet-type determination sensor 37 detects the quality and thickness of the sheet P inserted between the pair of the sheet holding plates 11.

The controller 40 of the sheet remover 1 can communicate with a controller 190 of the image forming apparatus 100, which is or includes a conveying device, by wireless communication through, for example, BLUETOOTH or WI-FI connection. Accordingly, the detection state of the contact sensor 35 is transmitted to the controller 190 of the image forming apparatus 100 via the controller 40 of the sheet remover 1. When the contact sensor 35 is in the detection state, the controller 190 can display, on a display panel 191, an explanatory screen prompting a winding operation of the sheet P as in FIG. 10 to FIG. 11.

Figure 22:
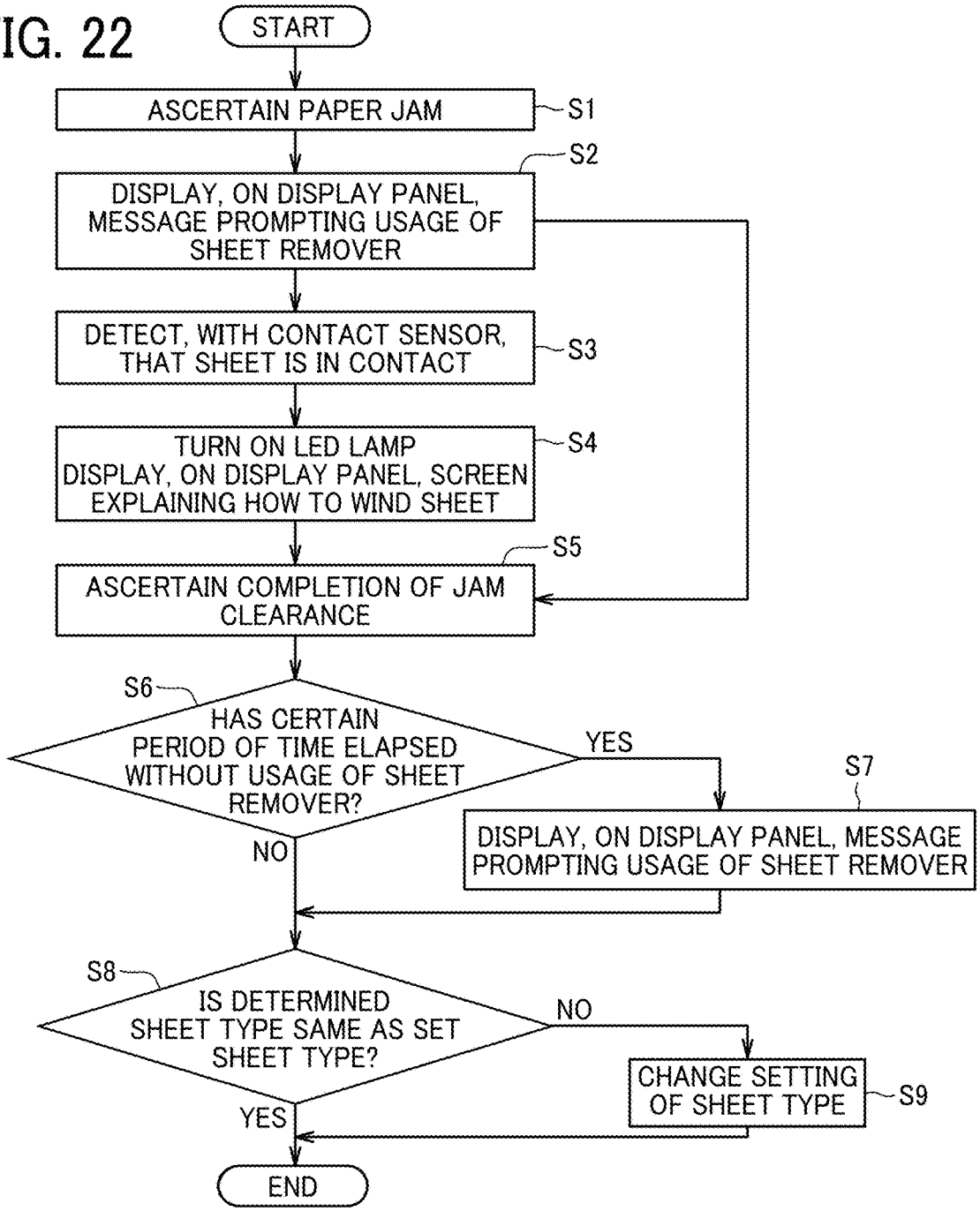
FIG. 22 is a flowchart illustrating a jam clearance procedure performed by the sheet remover of FIG. 20.

Referring now to FIG. 22, a description is given of an operation procedure when the sheet P causes a jam of the image forming apparatus.

In step S1, the controller 190 of the image forming apparatus 100 ascertains a paper jam in the image forming apparatus 100.

In step S2, the controller 190 of the image forming apparatus 100 displays, on the display panel 191, a message prompting the jam clearance with the sheet remover 1.

In response to the message, an operator inserts the sheet P jammed in the image forming apparatus into the through part 23 of the sheet remover 1 to bring the leading end of the sheet P into contact with the contact face 13*a*.

As a result, in step S3, the detection state of the contact sensor 35 changes. In addition, in step S3, the sheet-type determination sensor 37 determines the type of the sheet P.

Then, a change in the detection state of the contact sensor 35 is transmitted to the controller 40 of the sheet remover 1 and further to the controller 190 of the image forming apparatus 100. In short, the detection state of the contact sensor 35 is transmitted to the controller 190 of the image forming apparatus 100 via the controller 40 of the sheet remover 1.

In step S4, the controller 40 turns on the LED lamp 36 to inform the operator that the winding operation can be performed. In addition, in step S4, the controller 190 of the image forming apparatus 100 displays, on the display panel 191, a screen explaining how to wind the sheet P with the sheet remover 1. Thus, the controller 190 of the image forming apparatus 100 prompts the operator to wind the sheet P.

When the sheet P is removed with the sheet remover 1, in step S5, the controller 190 of the image forming apparatus 100 ascertains that the jam clearance is completed, in other words, the jammed sheet P is removed from the image forming apparatus 100.

When the sheet P is removed without using the sheet remover 1, for example, when the sheet P is removed by hand, in step S5, the controller 190 of the image forming apparatus 100 also ascertains the completion of the jam clearance.

In step S6, the controller 190 of the image forming apparatus 100 determines whether the jam clearance is performed with the sheet remover 1, in other words, whether the detection state of the contact sensor 35 is changed upon jam clearance. In addition, in step S6, the controller 190 of the image forming apparatus 100 determines whether the jam clearance has taken a period of time equal to or longer than a given period of time.

When the sheet remover 1 is not used and the jam clearance has taken a period of time equal to or longer than the given period of time (YES in step S6), in step S7, the controller 190 of the image forming apparatus 100 displays, on the display panel 191, a message prompting the usage of the sheet remover 1. Thus, the controller 190 of the image forming apparatus 100 prompts the operator to use the sheet remover 1 next time and thereafter to perform the jam clearance in a shorter period of time.

On the other hand, when the sheet remover 1 is used or the jam clearance has not taken a period of time equal to or longer than the given period of time (NO in step S6), in step S8, the controller 190 of the image forming apparatus 100 determines whether the quality and thickness of the sheet P determined with the sheet-type determination sensor 37 in step S3 are the same as the quality and thickness set in the image forming apparatus 100.

When the quality and thickness of the used sheet P are different from the set quality and thickness (NO in step S8), in step S9, the setting on the image forming apparatus 100 is automatically changed to the setting of the used sheet P. Alternatively, the controller 190 of the image forming apparatus 100 displays, on the display panel 191, a message prompting the change of setting.

On the other hand, when the quality and thickness of the used sheet P are the same as the set quality and thickness (YES in step S8), the operation procedure that is illustrated in FIG. 22 is completed.

According to the embodiments of the present disclosure, the configuration of the sheet remover is not limited to the configuration in which the leading-end claws and the sheet holding plates that hold the sheet are fixed as in the above-described embodiment.

Figure 18:
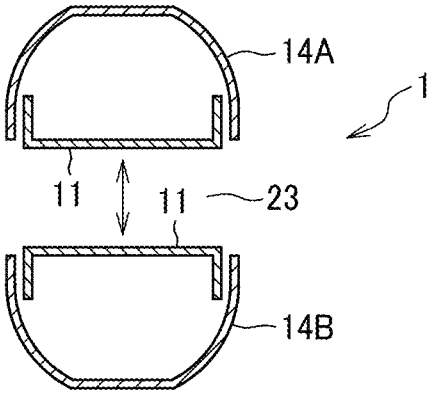
FIG. 18 is a cross-sectional view of a sheet remover according to another embodiment of the present disclosure.
Figure 19:
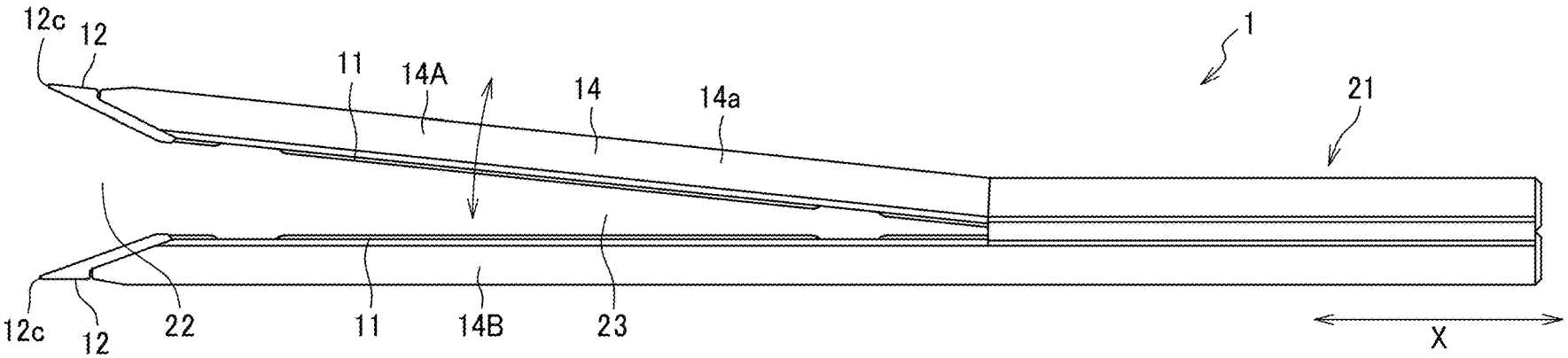
FIG. 19 is an external view of the sheet remover of FIG. 18.

For example, in the embodiment illustrated in FIG. 18, the sheet remover 1 includes winding guides 14A and 14B as a part of the outer circumferential surface of the sheet remover 1. The sheet holding plate 11 is fixed to the inside of each of the winding guides 14A and 14B. The winding guide 14A and one of the sheet holding plates 11 are opened and closed relative to the winding guide 14B and the other of the sheet holding plates 11 in the direction indicated by the double-headed arrow in FIG. 18 or FIG. 19. The winding guide 14A and the one of the sheet holding plates 11 are opened and closed in an appropriate mechanism by an appropriate operation performed by an operator such as a button operation or an opening and closing operation. In the sheet remover 1 of the present embodiment, the pair of sheet holding plates 11 sandwiches the sheet placed therebetween by the opening and closing operation. By rotating the sheet remover 1 sandwiching the sheet, the operator winds the sheet around the outer circumferential surfaces of the winding guides 14A and 14B. Thereafter, by taking out the sheet remover 1 from a device such as a conveying device, the operator removes the sheet jammed inside the device such as the conveying device. The pair of sheet holding plates 11 may press against both sides of the sheet to sandwich the sheet by the above-described opening and closing operation of the sheet holding plates 11 as in the present embodiment, or the sheet may be held between the sheet holding plates 11 as in the embodiment illustrated in, for example, FIG. 1.

Although a sheet that is jammed in a conveying device in an image forming apparatus is removed in the above description, the device for which the sheet remover of the embodiments of the present disclosure is used is not limited to the conveying device in the image forming apparatus described above provided that the device is a conveying device that conveys sheets.

Now, a description is given of some aspects of the present disclosure.

According to a first aspect, a sheet remover includes a pair of insertion-part formers and a pair of through-part formers. The pair of insertion-part formers forms an insertion part between the pair of insertion-part formers into which a sheet is inserted. The pair of through-part formers forms a through part between the pair of through-part formers through which the sheet is inserted. The through part is located downstream from the insertion part in a sheet insertion direction in which the sheet is inserted.

According to a second aspect, in the sheet remover of the first aspect, an outer circumferential surface of the sheet remover includes a winding portion along which the sheet is wound.

According to a third aspect, in the sheet remover of the first or second aspect, wherein a length of the insertion part in a thickness direction of the sheet decreases in the sheet insertion direction.

According to a fourth aspect, in the sheet remover of the third aspect, at least one of the pair of insertion-part formers includes a guide face inclined toward the through part in the sheet insertion direction to guide the sheet.

According to a fifth aspect, in the sheet remover of any one of the first to fourth aspects, at least one of the pair of insertion-part formers includes a curved upstream end in the sheet insertion direction.

According to a sixth aspect, in the sheet remover of any one of the first to fifth aspects, an outer circumferential surface of the sheet remover includes a planar portion at a position around the insertion part in the sheet insertion direction.

According to a seventh aspect, the sheet remover of any one of the first to sixth aspects, further including a contact part at a downstream end of the through part in the sheet insertion direction to contact the sheet.

According to an eighth aspect, in the sheet remover of the seventh aspect, the contact part is a face perpendicular to the sheet insertion direction.

According to a ninth aspect, in the sheet remover of any one of the first to eighth aspects, an outer circumferential surface of the sheet remover is curved at least at two diagonal positions in a cross-section in a direction perpendicular to the sheet insertion direction.

According to a tenth aspect, in the sheet remover of any one of the first to ninth aspects, an outer circumferential surface of the sheet remover includes a planar portion extending in the sheet insertion direction at a position not around the insertion part in the sheet insertion direction.

According to an eleventh aspect, in the sheet remover of any one of the first to tenth aspects, the sheet remover is a rod-shaped device having a length in the sheet insertion direction.

According to a twelfth aspect, a conveying device including the sheet remover of any one of the first to eleventh aspects.

According to a thirteenth aspect, the conveying device of the twelfth aspect includes a pair of conveyance passage formers forming a conveyance passage through which the sheet is conveyed. One of the pair of conveyance passage formers is openable and closable. The other of the pair of conveyance passage formers is disposed at a position to be contacted by the sheet remover.

According to a fourteenth aspect, an image forming apparatus includes the conveying device of the twelfth or thirteenth aspect.

According to one aspect of the present disclosure, a sheet can be easily removed.

Any one of the above-described operations may be performed in various other ways, for example, in an order different from the one described above.

The invention claimed is:

1. A sheet remover, comprising:

a pair of insertion-part formers forming an insertion part between the pair of insertion-part formers into which a sheet is inserted; and a pair of through-part formers forming a through part between the pair of through-part formers through which the sheet is inserted, the through part being located downstream from the insertion part in a sheet insertion direction in which the sheet is inserted, wherein a length of the insertion part in a thickness direction of the sheet decreases in the sheet insertion direction, and a length of the through part in the thickness direction of the sheet is constant in the sheet insertion direction.

2. The sheet remover according to claim 1, wherein an outer circumferential surface of the sheet remover includes a winding portion along which the sheet is wound.

3. The sheet remover according to claim 1, wherein at least one of the pair of insertion-part formers includes a guide face inclined toward the through part in the sheet insertion direction to guide the sheet.

4. The sheet remover according to claim 1, wherein at least one of the pair of insertion-part formers includes a curved upstream end in the sheet insertion direction.

5. The sheet remover according to claim 1, wherein an outer circumferential surface of the sheet remover includes a planar portion at a position around the insertion part in the sheet insertion direction.

6. The sheet remover according to claim 1, further comprising a contact part at a downstream end of the through part in the sheet insertion direction to contact the sheet.

7. The sheet remover according to claim 6, wherein the contact part is a face perpendicular to the sheet insertion direction.

8. The sheet remover according to claim 1, wherein an outer circumferential surface of the sheet remover is curved at least at two diagonal positions in a cross-section in a direction perpendicular to the sheet insertion direction.

9. The sheet remover according to claim 1, wherein an outer circumferential surface of the sheet remover includes a planar portion extending in the sheet insertion direction at a position not around the insertion part in the sheet insertion direction.

10. The sheet remover according to claim 1, wherein the sheet remover is a rod-shaped device having a length in the sheet insertion direction.

11. A conveying device comprising the sheet remover according to claim 1.

12. The conveying device according to claim 11, further comprising a pair of conveyance passage formers forming a conveyance passage through which the sheet is conveyed, wherein one of the pair of conveyance passage formers is openable and closable and the other of the pair of conveyance passage formers is disposed at a position to be contacted by the sheet remover.

13. An image forming apparatus comprising the conveying device according to claim 11.

* * * * *